US008105505B2

(12) United States Patent
Shokrieh et al.

(10) Patent No.: US 8,105,505 B2
(45) Date of Patent: Jan. 31, 2012

(54) ELECTRICALLY CONDUCTIVE POLYMERIC COMPOSITE MATERIAL

(75) Inventors: Mahmood Mehrdad Shokrieh, Tehran (IR); Saber Mirzaee, Tehran (IR); Ali Naghashpour, Tehran (IR)

(73) Assignee: Nokhbegan Institute of Technology (NITD), Tehran (IR)

( * ) Notice: Subject to any disclaimer, the term of this patent is extended or adjusted under 35 U.S.C. 154(b) by 49 days.

(21) Appl. No.: 12/498,464

(22) Filed: Jul. 7, 2009

(65) Prior Publication Data

US 2009/0294738 A1 Dec. 3, 2009

(51) Int. Cl.
*H01B 1/06* (2006.01)

(52) U.S. Cl. ..... 252/511; 252/387; 252/388; 252/396; 252/502; 252/521.6; 264/320; 423/448; 427/388.1; 427/512; 428/147

(58) Field of Classification Search ..... 252/387, 252/388, 396, 502, 521.6, 511; 423/448; 427/388.1, 512; 428/147; 264/320
See application file for complete search history.

(56) References Cited

U.S. PATENT DOCUMENTS

| | | | | |
|---|---|---|---|---|
| 7,591,973 | B2 * | 9/2009 | Takano et al. | 264/320 |
| 2008/0025906 | A1 * | 1/2008 | Lin et al. | 423/448 |
| 2008/0187718 | A1 * | 8/2008 | Takano et al. | 428/147 |

* cited by examiner

*Primary Examiner* — Khanh T Nguyen
(74) *Attorney, Agent, or Firm* — Barry Choobin; Choobin & Choobin Consultancy LLC

(57) ABSTRACT

An electrically conductive composite consisting of Vinylester (as an anti-corrosive matrix), woven carbon fibers (as the reinforcement and conductive material) and carbon black powder (as a conductive filler) is manufactured. Various weight percentages of the matrix, fibers and filler are examined. The product cured at room temperature. Low weight, high strength, high stiffness, chemically corrosive resistance, electrically conductive characteristics are obtained from the product. The product may serve as electrically conductive polymeric composites in chemically corrosive environment.

2 Claims, 4 Drawing Sheets

ELECTRICALLY CONDUCTIVE POLYMERIC COMPOSITE MATERIAL

FIELD OF THE INVENTION

The present invention relates to a low weight, high strength, high stiffness, anti-corrosion conductive polymeric composite material.

BACKGROUND OF THE INVENTION

Plastic industry is known as a dynamic industry in producing of new materials. Thermoplastic and thermoset resins are widely used by plastic industry and many researches are performed to improve the properties and performance of resin by adding various reinforcements and fillers. High performance of composite materials is caused that researchers pay attention to replace the conductive materials with conductive polymer composites.

Warlimont, et al. studied on manufacturing of lead-acid battery grids by using a multilayer structure. They increased corrosion resistance of grids and decrease the weight of the battery. Warlimont et al. proposed a grid manufactured by copper, lead and tin for lead-acid battery and improved the mechanical, electrical and corrosion resistance behavior of the material. Hill, et al. obtained a higher voltage by using a ceramic material as a battery grid.

In recent years, many researches are performed in manufacturing of batteries by plastic grids instead of lead grids. According to available research, plastics in the best conditions have 0.001 conductivity of lead. In addition, carbon poly-acetylene grids due to instability of poly-acetylene in air and light make some problems. Recent researches on replacement of lead alloy grid with high conductive porous material show that using porous graphite in lead-acid battery increases the performance of the battery. Leng, et al. manufactured a thermoset composite with conductive fillers and short fibers. Experimental results show that by adding 5 wt % nano-carbon particles and 2 wt % carbon short fibers 0.431 Ω-cm volume resistivity is obtainable. Yang, et al. manufactured a polyurethane thermoplastic composite with 5 wt % nano-tube carbon and measured $10^3$ Ω-cm volume resistivity. Cho, et al. manufactured a polyurethane composite with 30 wt % carbon black that its volume resistivity is in a range of 1-10 Ω-cm. Paik, et al. tested a polyurethane composite with 8 wt % nano-tube that its volume resistivity is about $0.4\times10^3$ Ω-cm. Farshidfar, et al. investigate volume resistivity of HDPE and EPDM with 70-30 mixing ratio and different percent of carbon black. By increasing carbon short fibers as filler, mechanical and electrical properties are increased.

Conductive materials in the prior art can not offer combined characteristics namely, low weight, high strength, high stiffness, chemically corrosive resistivity and electrically conductivity. Thus, there is a need for an invention of a new polymeric composite to be able to offer all aforementioned characteristics.

SUMMARY OF THE INVENTION

The principal object of the present invention is to provide a method for making electrically conductive and anti corrosion composite, comprising steps of:

Preparing a predetermined amount of vinyl-ester resin;

Preparing a predetermined amount of resin hardener to harden said vinyl-ester resin;

Preparing a predetermined amount of carbon black;

Preparing a predetermined amount of woven carbon fibers;

Combining said predetermined amount of vinyl-ester resin with said predetermined amount of resin hardener and obtaining a combination of vinyl-ester resin and resin hardener;

Filling said combination of vinyl-ester resin and resin hardener with said predetermined amount of Carbon black and obtaining a filled combination of vinyl-ester resin and resin hardener with carbon black;

Combining said filled combination of vinyl-ester resin and resin hardener with carbon black with said predetermined amount of woven carbon fibers; and obtaining said electrically conductive and anti corrosion composite, wherein said composite consists of: low weight, high strength, and high stiffness characteristics.

Yet another object of the present invention is to provide an electrically conductive and anti corrosion composite wherein said composite comprises of 75% of fiber by weight, 18.75% of Resin by weight and 6.25% of filler by weight.

Yet another object of the present invention is to provide a system for making electrically conductive and anti corrosion composite, comprising of:

Means for preparing a predetermined amount of vinyl-ester resin;

Means for Preparing a predetermined amount of resin hardener to harden said vinyl-ester resin;

Means for preparing a predetermined amount of carbon black;

Means for preparing a predetermined amount of woven carbon fibers;

Means for combining said predetermined amount of vinyl-ester resin with said predetermined amount of resin hardener and obtaining a combination of vinyl-ester resin and resin hardener, wherein said combination is filled with said predetermined amount of Carbon black and obtaining a filled combination of vinyl-ester resin and resin hardener with carbon Black.

BRIEF DESCRIPTION OF TABLES

In this study, hand lay-up method is used to manufacture a composite made of Vinyl-ester (as an anti-corrosive matrix), woven carbon fibers (as the reinforcement and conductive material) and carbon black powder (as the conductive filler). Specimens are cured at environment temperature (25° C.). In order to prevent any void, specimens are manufactured under pressure. In all cases, filler is mixed with the resin. The final composite specimens are manufactured with woven Carbon fiber and Carbon black with 1.25, 2.50, 3.75, 5.00, 6.25, 7.50, 8.75 wt % to Vinyl-ester resin as shown in Table 1.

TABLE 1

| Samples | Fiber (wt %) | Resin (wt %) | Filler (wt %) |
|---|---|---|---|
| C1 | 75 | 25.00 | 0.00 |
| C2 | 75 | 23.75 | 1.25 |

TABLE 1-continued

| Samples | Fiber (wt %) | Resin (wt %) | Filler (wt %) |
|---|---|---|---|
| C3 | 75 | 22.50 | 2.50 |
| C4 | 75 | 21.25 | 3.75 |
| C5 | 75 | 20.00 | 5.00 |
| C6 | 75 | 18.75 | 6.25 |
| C7 | 75 | 17.50 | 7.50 |
| C8 | 75 | 16.25 | 8.75 |

Figure 1:
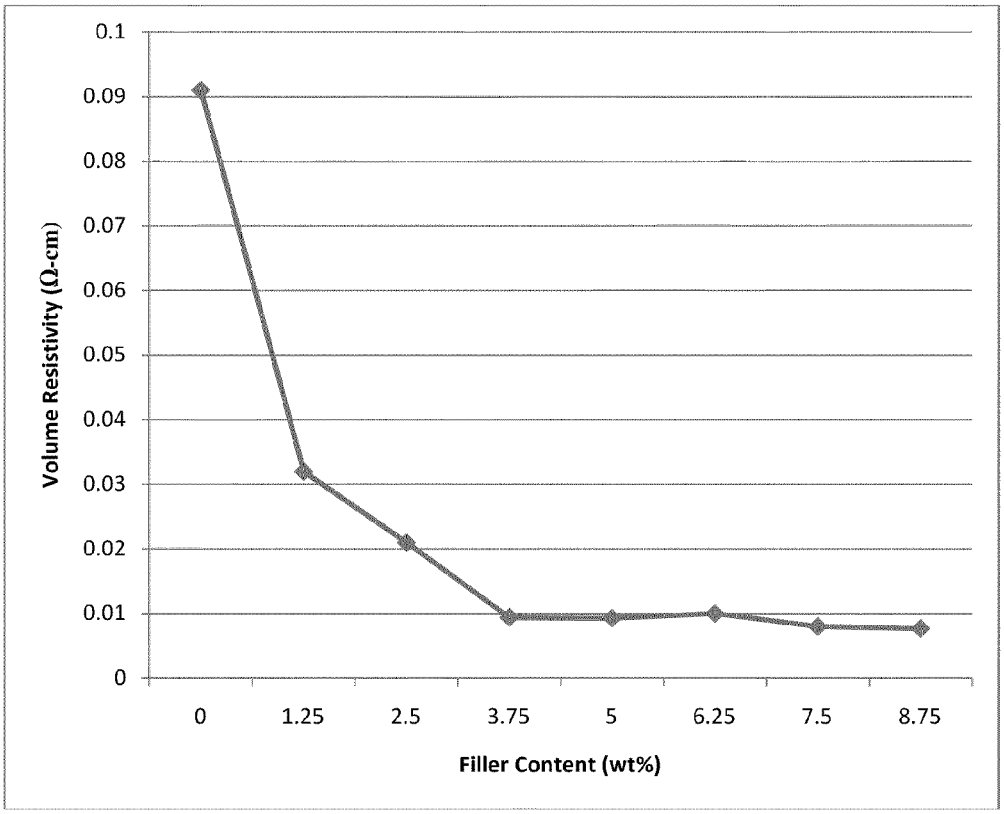
FIG. 1 shows the volume resistivity changes of the composites versus the filler content.

FIG. 1 illustrates volume resistivity test which are performed in accordance with ASTM D991. Also stiffness and strength of the specimens are measured using ASTM 3039-76 standard.

TABLE 2

| Specimen | Filler (wt %) | Volume resistivity Ω-cm |
|---|---|---|
| SP-C1 | 0.00 | 0.0910 |
| SP-C2 | 1.25 | 0.0320 |
| SP-C3 | 2.50 | 0.0210 |
| SP-C4 | 3.75 | 0.0094 |
| SP-C5 | 5.00 | 0.0093 |
| SP-C6 | 6.25 | 0.0100 |
| SP-C7 | 7.50 | 0.0080 |
| SP-C8 | 8.75 | 0.0077 |

Table 2 is an alternative representation of FIG. 1.

Table 2 presents the volume resistivity of carbon/vinyl-ester composites in terms of different weight percent of carbon black.

TABLE 3

| Specimen | | $i_{corr}$, $\left(\frac{\mu A}{cm^2}\right)$ | $E_{corr}$, (mV) |
|---|---|---|---|
| Lead alloy | | 242.67 | −469.7 |
| Filler (% wt) | 0.00 | 42.44 | 23.81 |
| | 1.25 | 1.44 | 70.39 |
| | 2.50 | 10.14 | 234.9 |
| | 3.75 | 14.97 | 275.9 |
| | 5.00 | 19.36 | 354.4 |
| | 6.25 | 6.98 | 432.6 |
| | 7.50 | 6.10 | 370 |
| | 8.75 | 2.68 | −21.02 |

Table 3 presents the corrosion current density and corrosion potential for composites and lead alloy.

DETAILED DESCRIPTION OF THE INVENTION

Volume Resistivity Test

Volume resistivity is measured by four-probe technique according to ASTM D991 standard. Source voltage, voltage of specimen and current passed through electrodes are measured by three multi-meters. Volume resistivity is calculated from potential decrease and sample characteristics by the following equation:

$$\rho = Vwdk/Il \quad (1)$$

Where:

ρ: volume resistivity, (Ω-Cm)

V: potential difference, V, across potential electrodes

I: current through the current electrodes, A w: width of specimen d: thickness of specimen l: distance between potential electrodes k: Factor depending on units of w, d and l, i.e., k is 0.001 if w, d and l are in millimeters and 0.0254 if they are in inches.

Samples are constructed with Carbon woven fabrics and Vinyl-ester resin with different percent of Carbon black filler. Variation of volume resistivity for various weight percent of filler is shown in Table 2. Also, volume resistivity change for various filler percent is plotted in FIG. 1. It is observed that increasing percentage of Carbon black filler in composites decreases volume resistivity. Based on the results obtained from the experiments it is observed that the best volume conductivity of composites is achieved by using a 5 wt % of Carbon black.

Corrosion Resistivity Test

Figure 2:
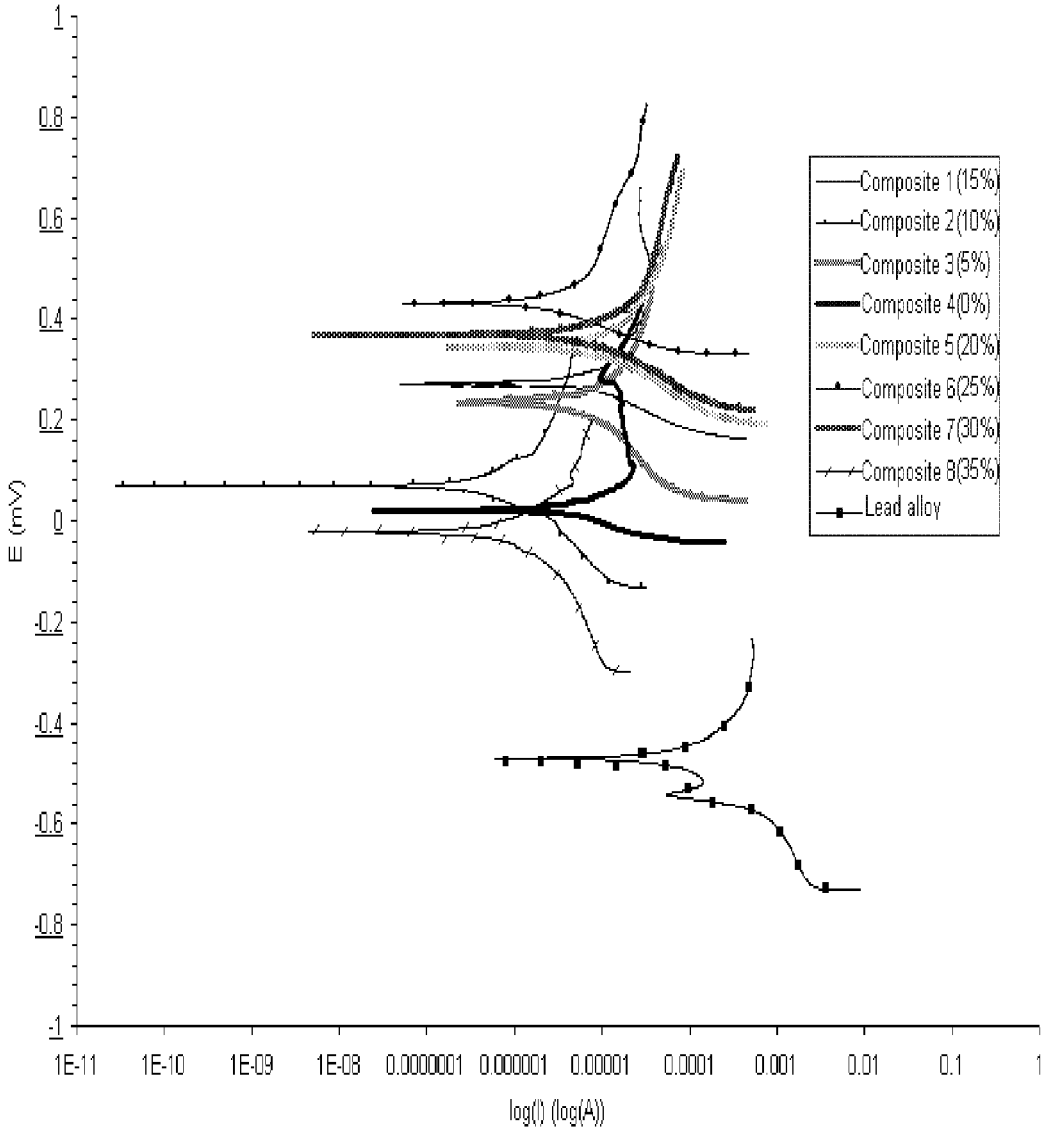
FIG. 2 shows the corrosion potential versus logarithm of the current for lead alloy grid and carbon/vinyl-ester with various filler contents.

In order to characterize the corrosion resistivity of the composites, some experiments are performed in chemical corrosion conditions. The tests are performed in a 25 vol % Sulphuric acid equals to 4.5 mol/lit. The electrolyte relative density is 1.26. The corrosion resistivity of composites is investigated in this electrolyte. According to ASTM G102 standard and using Tafel test apparatus, the corrosion rates of composites with different filler content and lead alloy are characterized and compared with each other. The results of Tafel tests for composites with and without filler and lead alloy are shown in FIG. 2. The results show that the corrosion resistivity of composites is higher than lead alloy. Corrosion current density of specimens is calculated from the results of Tafel test using the following equation:

$$i_{corr} = \frac{I_{corr}}{A} \quad (2)$$

Where A is the cross section of specimen (equal to 0.785 cm2) and icorr is corrosion current density (□A/cm2) and Icorr is corrosion current. Corrosion current density has a direct relation with the corrosion rate. The corrosion speed is calculated by the following equation:

$$\text{Corrosion speed} = 128.62 \times i_{corr} \times \frac{M}{N\rho} \quad (3)$$

Where

M: Mass, gr

N: Capacity

ρ: Density, gr/cm$^3$

Corrosion current density (icorr) and corrosion potential (Ecorr) of composites with different percentages of carbon black and lead alloy are shown in Table 3. The results show that composites with different percentages of carbon black show a better corrosion potential and corrosion current density behavior than lead alloy.

Figure 3:
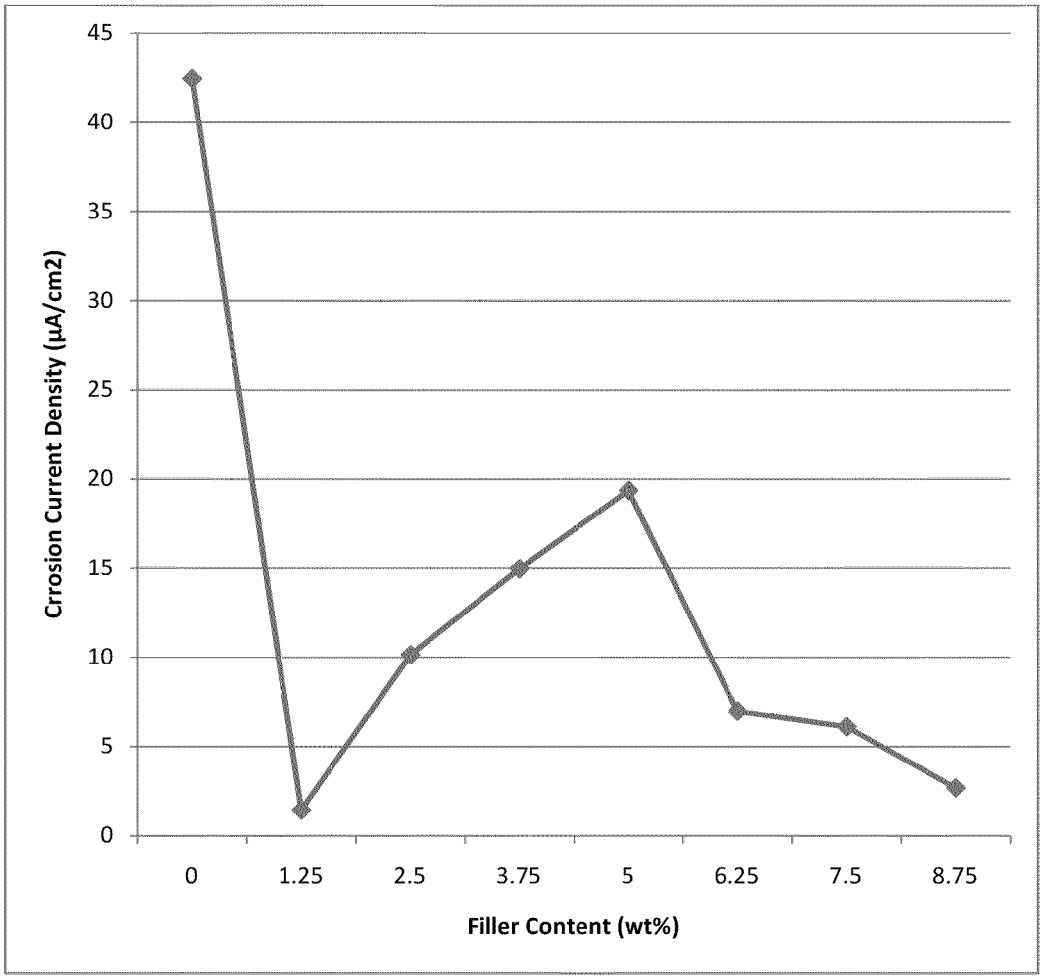
FIG. 3 shows the variation of corrosion current density with the filler content.
Figure 4:
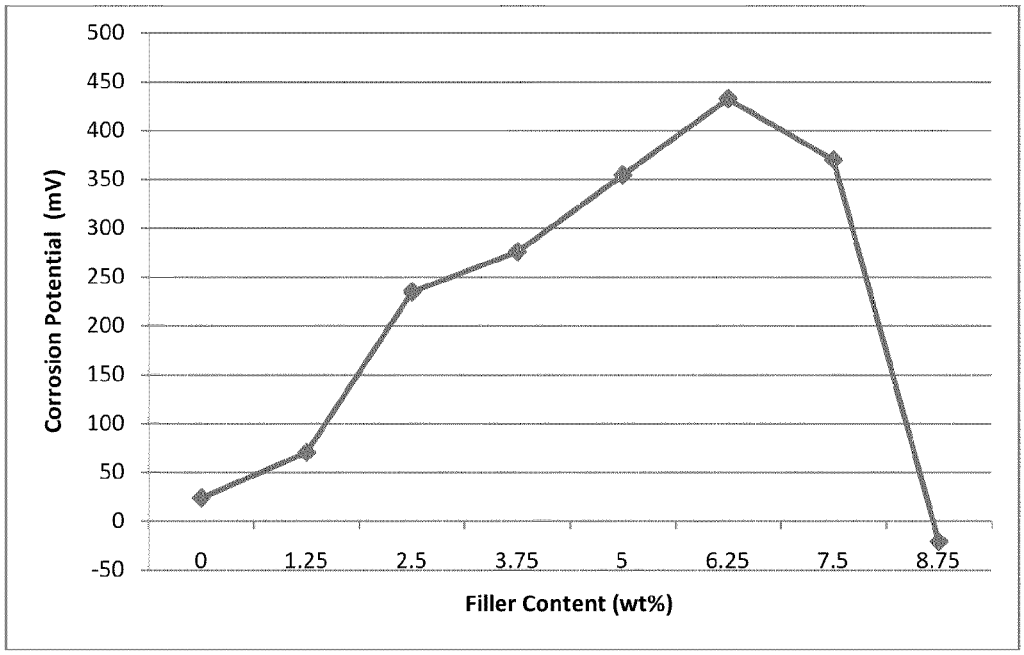
FIG. 4 shows the variation of corrosion potential versus filler content.

As shown in FIG. 3, it is observed that composites with different percentages of filler in comparison with composites without filler show lower corrosion current densities. Since corrosion rate has a direct relation with the corrosion current density (Eq. 3), therefore the corrosion rate of composites with different percentages of filler is less than the same composites without filler. In general, it can be observed that increasing Carbon black filler in composites decreases both corrosion current density and corrosion speed. As shown in FIG. 4, by increasing the percentage of filler up to 6.25 wt %, corrosion potential increases. By increasing the percentage of filler (7.5 wt % and 8.75 wt %) corrosion potential decreases. As corrosion potential of lead alloy is −469.7 mV and test conditions are the same for all specimens, Carbon/Vinyl-ester composites with and without filler perform better than the lead alloy in corrosive environment.

Stiffness and Strength Tests

In order to characterize the mechanical properties of the composites, stiffness and strength tests are performed based on ASTM 3039-76 standard. The stiffness and strength of composites are measured equal to 115 GPa and 1500 MPa, respectively. The density of composites and lead alloy are equal to 1680 kg/m$^3$ and 10880 kg/m$^3$, respectively. The stiffness and strength of lead alloy are equal to 14 GPa and 47.2 MPa, respectively. Therefore the specific stiffness of composites and lead alloy are 0.0680 GPa/(kg/m$^3$) and 0.0013 GPa/(kg/m$^3$), respectively. Also, the specific strength of composites and lead alloy are 0.8930 MPa/(kg/m$^3$) and 0.0043 MPa/(kg/m$^3$), respectively. These results show that polymeric composites presented in this invention is much lighter, stiffer and stronger than the lead alloy.

The description of the embodiment set forth above is intended to be illustrative rather than exhaustive of the present invention. It should be appreciated that those of ordinary skill in the art may make certain modifications, additions or changes to the described embodiment without departing from the spirit and scope of this invention as claimed hereinafter.

We claim:

1. A method for making electrically conductive and anti corrosion composite, comprising steps of:

preparing a predetermined amount of vinyl-ester resin;

preparing a predetermined amount of resin hardener to harden said vinyl-ester resin;

preparing a predetermined amount of carbon black;

preparing a predetermined amount of woven carbon fibers;

combining said predetermined amount of vinyl-ester resin with said predetermined amount of resin hardener and obtaining a combination of vinyl-ester resin and resin hardener;

filling said combination of vinyl-ester resin and resin hardener with said predetermined amount of carbon black and obtaining a filled combination of vinyl-ester resin and resin hardener with carbon black;

combining said filled combination of vinyl-ester resin and resin hardener with carbon black with said predetermined amount of woven carbon fibers; and obtaining said electrically conductive and anti corrosion composite, wherein said composite consists of: low weight, high strength, and high stiffness characteristics and, wherein said electrically conductive and anti corrosion composite comprises of 75% of fiber by weight, 18.75% of resin by weight and 6.25% of carbon black by weight.

2. A systems for making electrically conductive and anti corrosion composite, which comprises of 75% of fiber by weight, 18.75% of resin by weight and 6.25% of carbon black by weight, comprising of:

means for preparing a predetermined amount of vinyl-ester resin;

means for preparing a predetermined amount of resin hardener to harden said vinyl-ester resin;

means for preparing a predetermined amount of carbon black;

means for preparing a predetermined amount of woven carbon fibers;

means for combining said predetermined amount of vinyl-ester resin with said predetermined amount of resin hardener and obtaining a combination of vinyl-ester resin and resin hardener, wherein said combination is filled with said predetermined amount of Carbon black and obtaining a filled combination of vinyl-ester resin and resin hardener with carbon black; and means for combining said predetermined amount of woven carbon fibers with said obtained combination of vinyl-ester resin, resin hardener and carbon Black and obtaining a combination of vinyl-ester resin, resin hardener, Carbon black and Woven carbon fibers.

* * * * *